United States Patent [19]

Howard et al.

[11] Patent Number: 5,064,440

[45] Date of Patent: Nov. 12, 1991

[54] LAUNDRY EVALUATION PIECE INCLUDING BLEACHING ACTIVITY INDICATOR SWATCH

[75] Inventors: Eugene R. Howard, Breese; Terry K. Anderson, Edwardsville, both of Ill.

[73] Assignee: Artex International, Inc., Highland, Ill.

[21] Appl. No.: 478,829

[22] Filed: Feb. 12, 1990

[51] Int. Cl.[5] ..... D06L 3/06

[52] U.S. Cl. ..... 8/137; 8/108.1; 8/543; 8/638

[58] Field of Search ..... 8/137, 638, 108.1

[56] References Cited

U.S. PATENT DOCUMENTS 3,094,373 6/1963 Luechauer ..... 8/137

3,926,830 12/1975 Horiguchi et al. ..... 252/135

OTHER PUBLICATIONS

J. Griffiths, "Colour and Constitution of Organic Molecules" (Academic Press), 1976, pp. 3–9.

*Primary Examiner*—A. Lionel Clingman

*Attorney, Agent, or Firm*—Jerome A. Gross

[57] ABSTRACT

The effect of chlorine concentration in laundry solutions on the life of the laundered fabrics is signalled by a chlorine concentration indicator swatch, in which contrastingly hued dyes, including one whose chlorine resistance is measurably stronger than the other, are combined to dye fabric test swatches an initial color. Including such fabric test swatches in chlorine-containing laundry solutions causes visually discernable changes in the hues of the swatches as the bleaching action progressively subtracts those dyes of lesser resistance. Chlorine concentration which, if excessive, seriously impairs laundered fabrics, may be determined by visually inspecting the swatches.

6 Claims, 2 Drawing Sheets

FIG. 1 - TYPICAL 3-DYE PROGRESSION
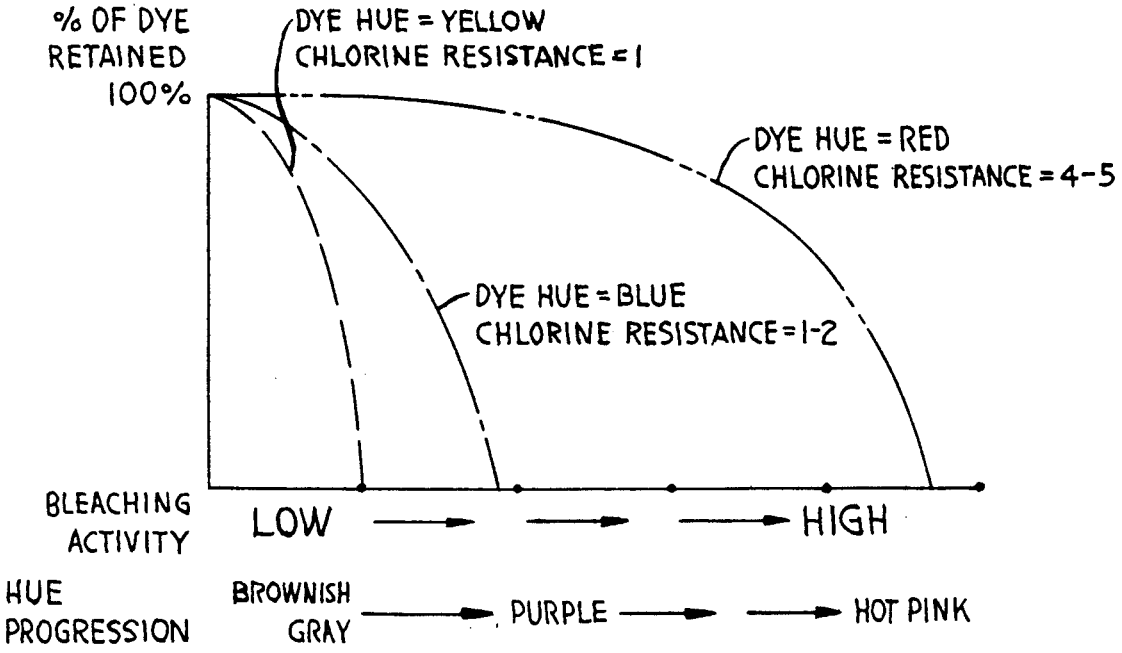
FIG. 2 - TYPICAL 4-DYE PROGRESSION
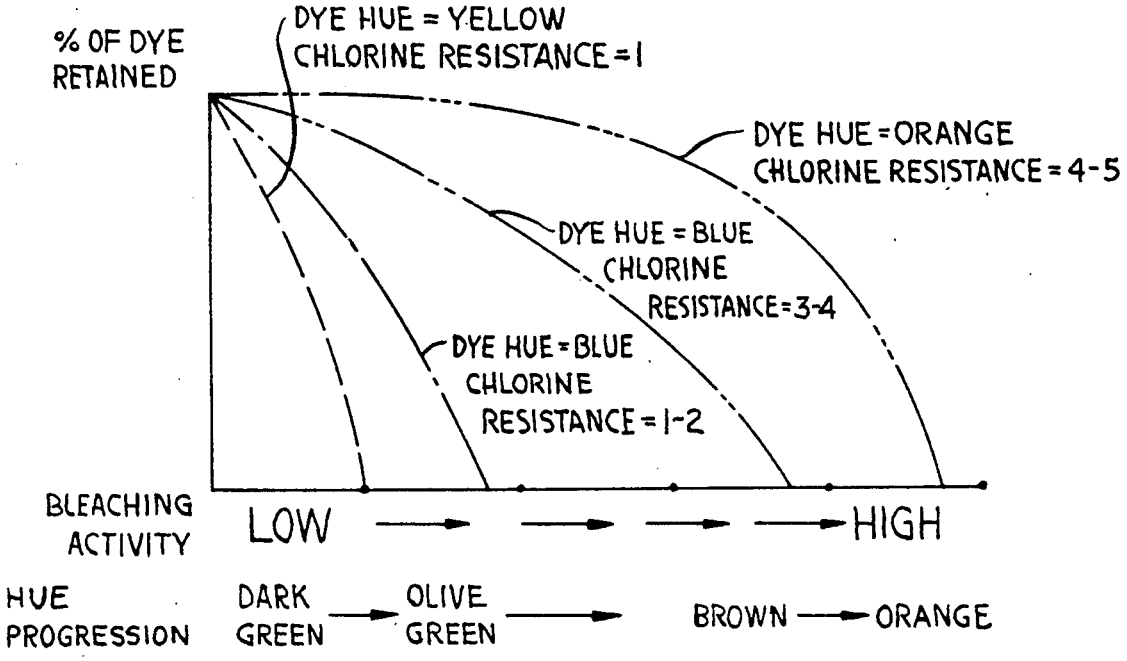

LAUNDRY EVALUATION PIECE INCLUDING BLEACHING ACTIVITY INDICATOR SWATCH

BACKGROUND OF THE INVENTION

1. Field of the Invention

This invention relates to recording and interpreting factors present in laundering a batch of commercial linens, and particularly to the inclusion of a dyed fabric swatch which records the chlorine bleach activity on the linens.

2. Description of the Related Art

Chlorine is the bleaching agent most commonly used in laundering fabrics such as those used in commercial linens.

Overbleaching reduces the useful life of textile products; it weakens them by damaging their fiber, and reduces their aesthetic appeal by facing or removing color. Overbleaching may occur in the commercial laundering process, as it is often difficult for management to insure that appropriate quantities of chlorine bleach are used in an individual laundry batch.

The amount of bleach included in a particular laundry solution may not, of itself, be a sufficient basis for concluding whether or not the optimum concentration of chlorine was used. Factors other than chlorine concentration may increase the extent of bleaching activity—for example, high temperature and incorrect pH of the laundry solution. On the other hand, excess soil (much of which might have been removed by pre-rinsing) may use up part of the chlorine activity present.

It is conventional to utilize test pieces in a laundry batch, the pieces having indicators attached for various purposes. Thus, the temperature of a laundry solution may be recorded by use of a temperature test strip. Wool, an animal fiber, may be destroyed by excessive alkalinity; hence it is known to attach a swatch of wool fabric onto a laundry test piece. The extent to which the wool swatch has been "eaten away" in laundering reflects the alkalinity of the laundry solution. The activity of part of the chlorine used in a laundry solution may be taken up by excessive soil, some of which might have been removed by pre-rinsing. The presence of such excess soil is detectable by its re-deposition on a clean white swatch to indicate soil re-deposition. A conventional "fluidity" test determines how much cotton fiber a single laundering has consumed by measuring the decrease in fiber content in a swatch of the same fabric as the laundry batch with which it was laundered.

According to Luechauer U.S. Pat. No. 3,094,373, change in hue of a single fabric test swatch may serve as a record of the chlorinity of a laundry solution. Luechauer accomplishes this by including in each laundry batch a swatch with a single dye, which dye will actually change its hue when the swatch is laundered in a chlorine-containing solution.

SUMMARY OF THE INVENTION

In the present invention a test piece, to be added to each batch in laundering commercial linens, includes one or more specially dyed swatches which serve as a reliable indicator of the bleaching activity of the laundry solution. Conventional indicators of alkalinity and excess soil are preferably included; a temperature indicator is optional, as is a swatch for use in a fluidity test. When interpreted along with those conventional indicators, these new specially dyed swatches permit drawing accurate conclusions whether the chlorine concentration of a particular solution was insufficient, optimum, or excessive.

Instead of following the Luechauer teaching, the dyes of the present invention do not themselves change hue. Bleaching activity indicating test swatches are dyed to an initial mixed color using a combination of contrastingly hued dyes, each having a different chlorine resistance. The dye of least resistance will fade out under mild chlorinity, thus changing the hue of the swatch. The term "hue" is here used to mean the common names of colors, rather than their lightness or saturation.

Laundering, in a chlorine-containing solution, of a swatch so dyed to an initial mixed color by a combination of contrastingly hued dyes, each having a different chlorine resistance initiates a course of hue subtraction. As the least chlorine resistant dye fades and is removed, that dye's hue is subtracted from the initial mixed color. This subtraction results in a hue visibly different from the initial hue of the swatch. As laundering continues, the next least resistant dye fades and is substantially removed, its absence again markedly changing the hue of the swatch. When all dyes except the most chlorine resistant dye have been subtracted by continued laundering only the hue of that dye remains. Thus the bleaching activity of the particular laundry solution shows as a progression of hue changes the dyed swatch.

Verification of that bleaching activity is provided by using, in the same batch of laundry, an additional test swatch. Such additional swatch is dyed to an initial mixed color with either: dyes of the same hues as those used in the first swatch but with at least one dye, preferably the most chlorine resistant, having a significantly different chlorine resistance from that dye of the same hue used in the first swatch; or dyes of hues different from those hues used in the first swatch. In either case, a visual progression of hue changes different from that of the first swatch will occur, as single dyes are sequentially subtracted. Comparison of the hue changes of the two swatches, after they have been so laundered together, serves to verify the conclusion to be reached as to the bleaching activity of the solution.

When that conclusion has been reached, to arrive at a firm judgment whether the chlorine concentration was less than optimum, substantially optimum, or excessive, the conventional test elements for alkalinity, excess soil and temperature may be taken into account.

BRIEF DESCRIPTION OF THE DRAWINGS

FIG. 1 illustrates the subtractive progression of color change that occurs in a swatch dyed with three contrastingly hued dyes of differing chlorine resistances upon laundering of the swatch in a chlorine-containing solution.

FIG. 2 illustrates substantially the same type of progressive color change, but contemplates the use of four such dyes.

DESCRIPTION OF THE PREFERRED EMBODIMENT

Figure 3:
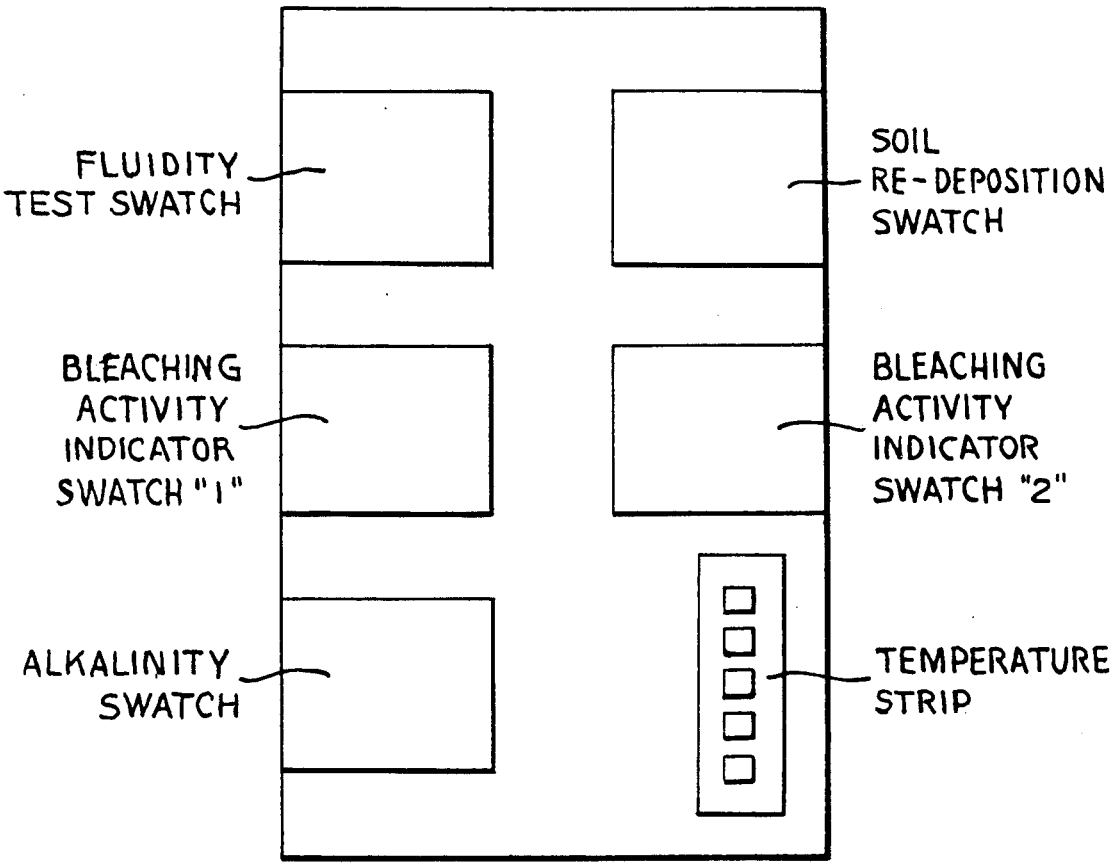
FIG. 3 illustrates a test piece including two of the bleaching activity indicator swatches along with indicators of alkalinity, excessive soil; an indicator of temperature and a swatch used for the conventional "fluidity" test for fiber diminution.

Dyes are now commercially available which are rated from one to five for chlorine sensitivity, with a dye rated one being weakly resistant to chlorine and a dye rated five being strongly resistant to chlorine. The bleaching characteristics of these dyes, such as those marketed by Ciba-Geigy under the tradename "Cibacron," are substantially predictable; as the bleaching activity of the laundry solution increases, dyes having higher chlorine-sensitivity ratings (that is, being more resistant to chlorine) are bleached.

The present invention, in contrast to the prior art, uses a combination of dyes to dye a test swatch an initial mixed color:

(a) using a minimum of two dyes of contrasting hues;

(b) each dye having a substantially different resistance to chlorine.

As the bleaching activity of the laundry solution is increased to exceed the chlorine resistance of the dye having the lesser chlorine resistance, that dye is eliminated, while the more resistant dye remains in the test swatch, changing its hue; thus, the process is one of hue subtraction; the number of such hue subtractions being dependent on the number of dyes used in the initial mixed color.

While the bleaching activity of a laundry solution is directly correlated to its chlorine concentration, other factors, principally high temperature and alkalinity (pH), increase the extent of bleaching, so these play a part in the hue change. Also, though a chlorine concentration may be high, it may be partly consumed in reacting excessive soil present. Hence, indicators of alkalinity, excess soil, and temperature included in the test piece aid in interpreting whether the chlorine concentration was appropriate.

The curves depicted on the graphs of FIGS. 1 and 2 are therefore merely illustrative. In both figures, the amount of each dye remaining in a swatch is plotted on the ordinate, against a solution of sufficient bleaching activity to bleach dyes having chlorine sensitivity ratings ranging from 1–5 on the abscissa.

The process of hue subtraction in a single swatch dyed to an initial mixed color of brownish-grey by a combination of a dye of each of the three primary hues is illustrated in FIG. 1. The Ciba-Geigy Cibacron yellow dye used is rated 1, and is least resistant; the Cibacron blue dye used is rated 1–2, and is of intermediate resistance; and the Cibacron red dye is rated 4–5, and is the most resistant of the three. As FIG. 1 illustrates, on laundering of the swatch in a chlorine-containing solution, the initial brownish-grey color will change to a purple hue as the yellow dye is subtracted; on increased chlorinity and the resulting subtraction of the blue dye, this purple hue will change to a reddish hue such as hot pink. Ideally, for most graphic color change these dyes would be rated 1, 3 and 5.

While fairly adequate indication of the bleaching activity of the laundry solution may be obtained by us-e of only one swatch, two or more test swatches, differing from each other, laundered together confirm the bleaching activity indicated independently by each. Availability of dyes having chlorine resistances of one through five of each of the primary hues would make possible a two swatch system as follows: second swatch might be red 1, yellow 3 and blue 5. In this case, the hue progression would be from brownish-grey to green to blue. A third swatch could also be used, the blue having a rating of 1; the red a rating of 3, and the yellow having a rating of 5. Hue progression in this swatch would be from greyish-brown to orange to yellow.

As may also be seen in FIG. 1, a swatch of only two primary colors may be used. Thus, were the yellow dye illustrated in FIG. 1 omitted, the hue progression would be from purple to red. A combination of two swatches, each of only two primary hues could also be used, as could a combination of swatches each having a different number of dyes in their initial mixed color, if the dyes having the greater chlorine resistances were of different hues.

As illustrated in FIG. 2, a test swatch may also be dyed to its initial mixed color by a combination of four dyes of differing hues, at least one of which is a dye of a hue intermediate to two primary hues, for example, orange in combination with yellow, blue, and a second blue. The Cibacron yellow may be rated 1; the first Cibacron blue rated 1–2, the second Cibacron blue rated 3–4; and the Cibacron orange rated 4–5. On laundering, the initial mixed dark green color of this swatch turns to olive green as the yellow dye is subtracted, to brown as the more weakly resistant blue dye is subtracted, then to an orange hue as the less resistant blue dye is subtracted. FIG. 2 illustrates these three progressive color subtractions Such a test swatch, laundered with the swatch of FIG. 1, provides a clear visual comparison of bleaching activity. For ease of interpreting the bleaching activity indicated by the terminal hue of a swatch, a color chart showing various stages of hue progression may be used for comparison.

The fabric used for the chlorine activity indicator test swatches may be the same as the fabric being laundered; however, the hue subtractive phenomenon, relying on the predictable bleaching characteristics of the dyes, operates independently of the type of fabric used.

Bleaching activity sufficient to remove a weakly resistant dye, such as the dye of yellow hue in FIG. 1, is unsafe for colored fabrics; bleaching activity sufficient to affect a less resistant dye such as the second dye of blue hue in FIG. 2 is unsafe for white fabrics. Bleaching activity sufficient to affect a strongly resistant dye such as the dye of red hue in FIG. 1 and the dye of orange hue in FIG. 2 is appropriate only for "salvage" loads, in which fabrics are so heavily soiled that they must be discarded unless such deliberate overbleaching can extend their useful life.

The present invention includes any combination of dyes of visibly distinguishable hues and different chlorine resistances used in a swatch; and any grouping of swatches dyed so as to provide a different progression of hue change from that of any swatch in the group.

For interpreting whether factors in addition to chlorine concentration contributed to the hue change, the swatch of the present invention may be included sewn to a laundry evaluation piece having additional swatches or testing devices. The laundry evaluation piece of FIG. 3 includes two bleaching activity indicating swatches, along with conventional testing elements useful in determining the level of bleaching activity, all sewn onto a fabric backing. Conventional test elements so shown are an animal fiber fabric swatch, typically wool, which is diminished by excess alkalinity (pH); a white polyester fabric swatch to test for soil re-deposition; and optionally a temperature indicating strip which records the approximate maximum temperature of the laundry solution. This is a conventional paper strip encapsulated between plastic sheets whose block indicators change to reflect maximum temperature encountered. Also shown attached to the laundry evaluation piece of FIG. 3 is a cotton swatch, which may be detached and used subsequently in a laboratory conducted "fluidity" test to determine the fabric damage caused by the laundering.

As various modifications may be made in the constructions herein described and illustrated without departing from the scope of the invention, it is intended that all matter contained in the foregoing description or shown in the accompanying drawings shall be interpreted as illustrative rather than limiting.

We claim:

1. For use in monitoring laundry solutions, a chlorine concentration indicator comprising a fabric swatch dyed to an initial color by a combination of dyes with a first dye of a chosen hue and having a known chlorine resistance and a second dye of greater clorine resistance than that of the first dye and the hue of said second dye being visually distinguishable from the hue of said first dye, whereby on inclusion in a laundry solution containing chlorine, hue change of said swatch from the initial color toward the hue of said second dye serves as a visual indicator of the chlorine activity of the laundry solution.

2. A chlorine concentration indicator comprising the fabric swatch in claim 1, in combination with a second fabric swatch dyed to an initial color by a combination of two dyes of visually distinguishable hues, each dye having a different known chlorine resistance than the other dye, and one of said dyes having a different chosen hue or different known chlorine resistance from the dyes of said first fabric swatch.

3. A chlorine concentration indicator as set forth in claim 2, wherein the initial color of at least one of said swatches includes the dye of a third visually distinguishable hue, whereby the inclusion of said dye of said third visually distinguishable hue provides added visual contrast in the hue change of said swatch.

4. For use in monitoring laundry solutions, a chlorine concentration indicator, comprising a fabric swatch dyed to an initial color by a combination of three dyes being one dye of each of the primary hues, said dyes being a first dye having the least chlorine resistance of the three dyes, said resistance being within the range of chorine bleaching activity to be monitored, further including a second dye having intermediate chlorine resistance, and a third dye having the greatest chlorine resistance of the three dyes, said resistance being within the range of chlorine concentration to be monitored, whereby on inclusion in a laundry solution containing chlorine, the hue change of the swatch from said initial color toward a hue comprising the mixture of said hues of intermediate and most chlorine resistance, and thence toward the hue of said dye of greater resistance, serves as a visual indicator of chlorine bleaching activity of such a laundry solution.

5. A chlorine concentration indicator comprising the fabric swatch as set forth in claim 4, in combination with a second fabric swatch dyed to an initial color by a combination of three dyes, being one dye of each of the primary hues, said dyes being a first dye having the least chlorine resistance of the three dyes, said resistance being within the range of chlorine bleaching activity to be monitored, further including a second dye having intermediate chlorine resistance, and a third dye having the greatest chlorine resistance of the three dyes, said resistance being within the range of chorine concentration to be monitored, in which the hue of said dye having the greatest chlorine resistance is different from the hue of said dye having the greatest chlorine resistance in said first swatch, whereby on use of said second swatch together with the first swatch in a laundry solution, their relative color changes toward a hue or hues having the greater chlorine resistance provides a visual indication of the chlorine bleaching activity of such laundry solution.

6. For inclusion in a laundry, an evaluation piece containing one or more of (a) a temperature indicating and recording strip, (b) a fabric swatch fiber subject to destruction by alkalinity, and (c) a light color fabric swatch of a type subject to soil re-deposition, the improvement comprising a fabric swatch dyed to an initial mixed color by a combination of dyes including a first dye having a lesser chlorine resistance, said resistance being within the range of chlorine concentration to be monitored, and further including a second dye or greater chlorine resistance, whose hue is visually distinguishable from the hue of said first dye.

* * * * *

UNITED STATES PATENT AND TRADEMARK OFFICE

CERTIFICATE OF CORRECTION

PATENT NO. : 5,064,440

DATED : November 12, 1991

INVENTOR(S) : Howard, Eugene R., et al.

It is certified that error appears in the above-identified patent and that said Letters Patent is hereby corrected as shown below:

Col. 1, line 18, delete "facing" and insert ---fading---.

Col. 3, line 56, delete "us-e" and insert ---use---.

Col. 4, line 59, after "are" insert ---:---.

Col. 6, line 50, delete "or" and insert ---of---.

Signed and Sealed this

Ninth Day of March, 1993

*Attest:*

STEPHEN G. KUNIN

*Attesting Officer*

*Acting Commissioner of Patents and Trademarks*